US006621214B1

(12) United States Patent
Schloemer et al.

(10) Patent No.: US 6,621,214 B1
(45) Date of Patent: Sep. 16, 2003

(54) LAMP, AND LUMINAIRE WITH A REFLECTOR AND SUCH A LAMP

(75) Inventors: Heinz Schloemer, Selfkant (DE); Hans-Ulrich Rienäcker, Stolberg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 401 days.

(21) Appl. No.: 09/718,257

(22) Filed: Nov. 22, 2000

(30) Foreign Application Priority Data

Nov. 30, 1999 (DE) ..... 199 57 560

(51) Int. Cl.[7] ..... H01K 1/50

(52) U.S. Cl. ..... 313/578; 313/567; 313/569; 313/271; 313/272; 313/620; 313/574; 313/631

(58) Field of Search ..... 313/578, 567, 313/569, 271, 272, 238, 620, 574, 631

(56) References Cited

U.S. PATENT DOCUMENTS 4,302,698 A * 11/1981 Kiesel et al. ..... 313/222
4,682,072 A 7/1987 Ichihara et al. ..... 313/115
5,268,613 A * 12/1993 Cunningham ..... 313/113
6,271,622 B1 * 8/2001 Coushaine et al. ..... 313/272

FOREIGN PATENT DOCUMENTS

EP 1003205 A1 5/2000 ..... H02K/9/08
WO WO9849716 11/1998 ..... H01K/9/08

* cited by examiner

*Primary Examiner*—Edward J. Glick
*Assistant Examiner*—Jurie Yun

(57) ABSTRACT

In a high-power dual-filament incandescent lamp for use in a reflector having an optical axis, which incandescent lamp comprises two incandescent coils which are substantially parallel to one another, which in their correct operational positions are arranged substantially parallel to the optical axis of the reflector in a lamp bulb, and which can be operated alternately, the glass bulb is arranged such that it shows a horizontal and vertical displacement relative to the optical axis of the reflector when in the correct operational position.

5 Claims, 3 Drawing Sheets

LAMP, AND LUMINAIRE WITH A REFLECTOR AND SUCH A LAMP

Figure 1:
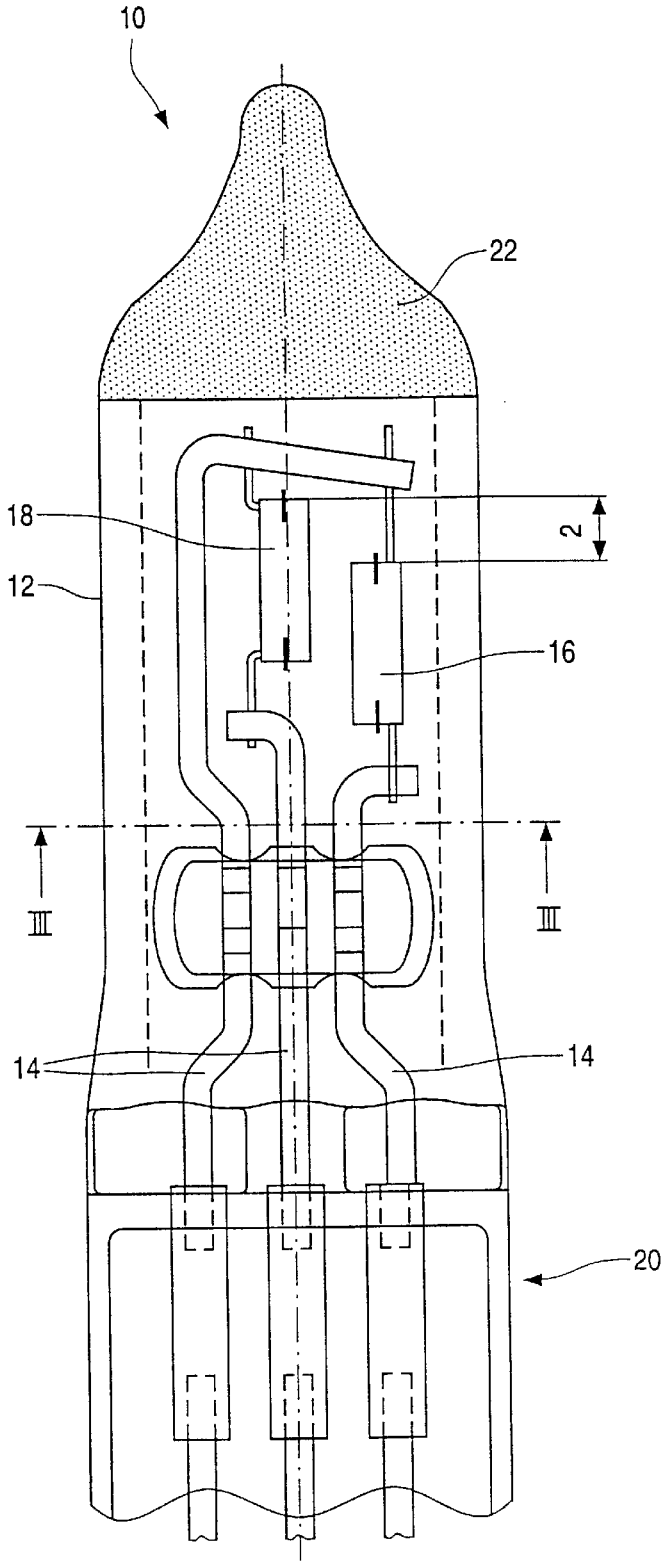

The invention relates to a lamp as well as to a luminaire comprising a reflector and such a lamp. In particular, the lamp here comprises a bulb having a bulb axis, and a main coil and an auxiliary coil whose coil axes are directed parallel to the bulb axis, as well as a lamp base comprising means for defining a mounting position with respect to the bulb axis. Said means for defining the mounting position at least define an "upper" position here. In addition, the invention relates to a corresponding luminaire with a reflector and a lampholder in which such a lamp is arranged and which comprises devices which cooperate with the means for defining the mounting position such that the lamp can be positioned in the lampholder exclusively in a required mounting position.

Such incandescent lamps serve in particular in motor vehicle lanterns for advantageously providing the possibility of generating a passing beam and a main or driving beam by means of a single incandescent lamp, without the necessity of moving the lamp by means of complicated adjustment mechanisms and motors between a passing beam and a driving beam position.

These lamps have to fulfill a number of technical requirements. Thus the coils must have a certain minimum distance to one another so that the operation of one coil, during which tungsten atoms are evaporated, will not lead to an undesirable deposition on the other, inoperative coil. Similarly, each coil must have a certain minimum distance to the inside of the lamp bulb (also referred to as burner), which is usually made of a glass and is rotationally symmetrical.

In addition, the incandescent lamps must be constructed such that they can be inserted into a lampholder arranged substantially in the extension of the optical axis of the reflector and thus as a rule centrally in the reflector, in which case it is arranged for the known incandescent lamps of the kind mentioned in the opening paragraph that one of the incandescent coils is positioned on the optical axis of the reflector after the lamp has been inserted in the reflector, while the other incandescent coil is arranged staggered with respect to this axis. The coil positioned on the optical axis serves to generate the passing beam and is denoted the auxiliary coil, while the coil in a staggered position with respect to the former serves to generate the forward driving beam and is denoted the main coil.

High-power dual-filament incandescent lamps are also known in which one incandescent coil extends parallel to the optical axis and the other one extends perpendicularly to this axis. It should be noted that the use of the verb "extend" with respect to an incandescent coil relates to the direction of the main axis of the incandescent coil, around which axis the actual coil portions are positioned in a helical rotational arrangement.

Now it is a problem in the known lamps that the diameter of the lamp bulb must be chosen to be comparatively great—on account of the positioning of the incandescent coils-, which requires a large volume in the bulb and thus a low maximum pressure of a gas enclosed in the bulb, whereas a high gas pressure is desired because the evaporation of tungsten atoms from the incandescent coils, which shortens lamp life, can be reduced thereby.

Accordingly, the invention has for its object to provide a lamp and luminaire of the kinds mentioned in the opening paragraph, in particular a motor vehicle headlamp, in which the bulb diameter and thus the bulb volume have been reduced so as to provide a possibility to utilize the positive effects of a high gas pressure and to prolong lamp life.

This object is achieved by means of a lamp, in particular a high-power dual-filament incandescent lamp, which has a lamp axis and a main coil and an auxiliary coil, whose coil axes are directed parallel to the bulb axis, and with a lampholder comprising means for defining a mounting position with respect to the bulb axis, said means for defining the mounting position defining at least an "upper" position. This lamp is characterized in that the bulb axis is vertically as well as horizontally displaced with respect to the coil axis of the auxiliary coil.

Similarly, the above object is achieved by means of a luminaire with a reflector and a lampholder in which a lamp as described above is arranged in that the lampholder comprises devices which cooperate with the means for defining the mounting position such that the lamp can only be positioned in the lampholder in a required mounting position.

The invention accordingly is based on the recognition that the coil axis of the auxiliary coil can be positioned with both vertical and horizontal displacement with respect to the bulb axis, which double displacement renders it possible to reduce the bulb diameter, and thus the volume enclosed by the bulb. The luminous efficacy of a lamp according to the invention can be considerably increased in this manner.

In this connection, the term "bulb axis" denotes a main longitudinal direction of the lamp burner chamber or lamp bulb. It is advantageous, however, for reasons of manufacturing technology when the bulb is substantially cylindrically shaped, in which case the bulb axis corresponds to the cylinder axis.

It is obvious that it is of minor importance in what position a lamp according to the invention is eventually used. Since such lamps are preferably used for headlights of motor vehicles, which radiate substantially horizontally forward with a given light cone shape, the term "upper" position is to be regarded as applying to this case. The terms vertical and horizontal are defined in the same manner. It is self-evident, however, that a different mounting position is desired in other applications, which would require a corresponding spatial adaptation of these terms. Lamps of this kind will have a preferred or prescribed mounting position in all cases because of the relative arrangements of the main and auxiliary coils.

Preferably, the coil axes of both the auxiliary coil and the main coil may be displaced with respect to the bulb axis. This is true in particular both for a horizontal and a vertical displacement, which renders possible a reduction of the bulb diameter.

In a preferred embodiment it is provided that the main coil is arranged such that in its correct operating position it is positioned between 0.7 and 1.7 mm laterally of a vertical plane in which the bulb axis is situated. Similarly, the main coil may lie between 2.1 and 3.1 mm below a horizontal plane in which the bulb axis is situated.

Preferably, the auxiliary coil is arranged such that in its correct operational position it is arranged at a distance of between 0.3 and 1.3 mm laterally of the vertical plane in which the bulb axis is situated, at the side of said plane opposed to the main coil. Furthermore, it may lie at a distance of between 0.1 and 1.1 mm below the horizontal plane in which the bulb axis is situated.

The bulb may be closed at one end in a sealing plane. This is usually achieved such that the body, i.e. the glass body forming the bulb, is pinched shut onto said sealing plane. The sealing plane encloses an angle with the vertical and horizontal planes. In such an arrangement, the paths of the wires to the coil or coils of a lamp can be considerably shortened. This renders possible a more precise positioning of the coil or coils in the bulb. In addition, such an arrangement is also more shockproof. It is obvious that such a departure from the prevalent opinion, i.e. that the sealing plane must extend in horizontal or vertical direction, in itself already has the relevant advantages, independently of the other characteristics of a lamp.

Preferably, the support wires which support the wires of the coils are arranged in one plane, preferably the sealing plane. These support wires can be given a comparatively short dimension in this manner. This leads to a particularly precise and shockproof total construction. It is possible in particular to choose the sealing plane, and thus the plane of the support wires, such that the necessary displacement with respect to the coils can be achieved by the coil wires themselves without further aids. In particular, the coils may be positioned such that they are contiguous to the plane of the support wires or intersect this plane. In such an arrangement, the necessary displacement of the coils can be realized without lengthening of the coil wires.

Figure 2:
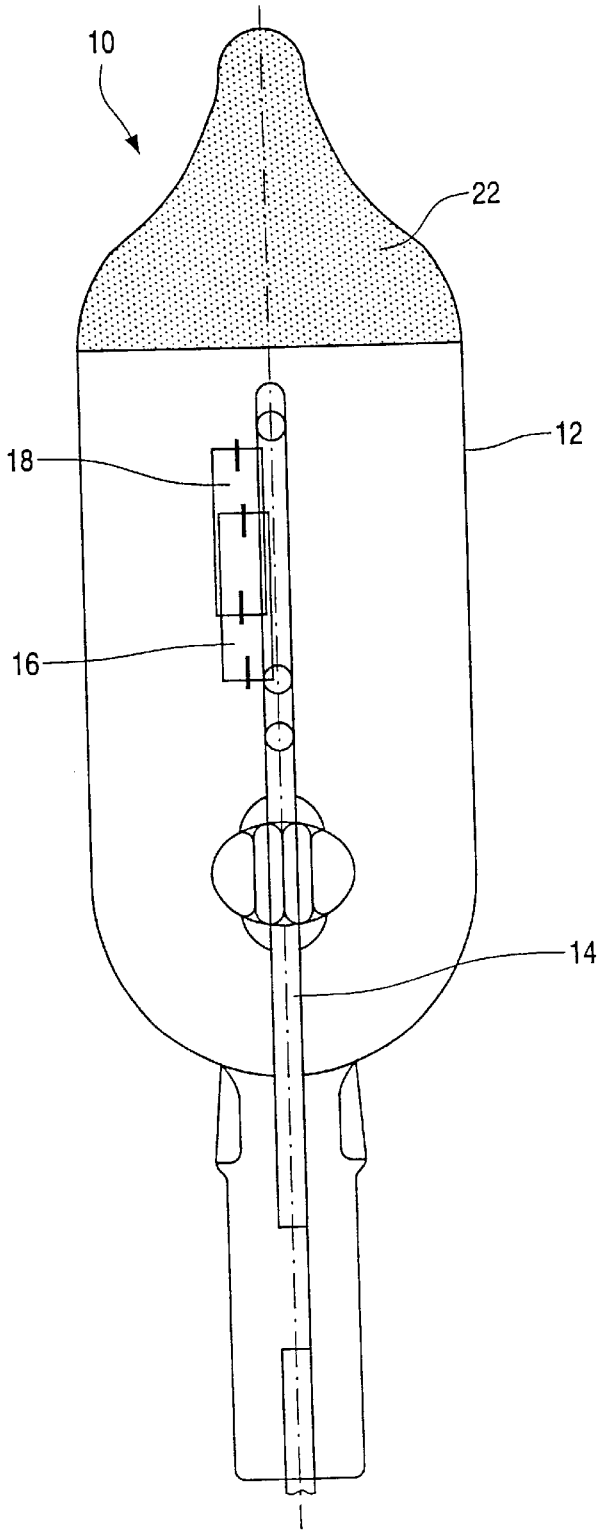
Figure 3:
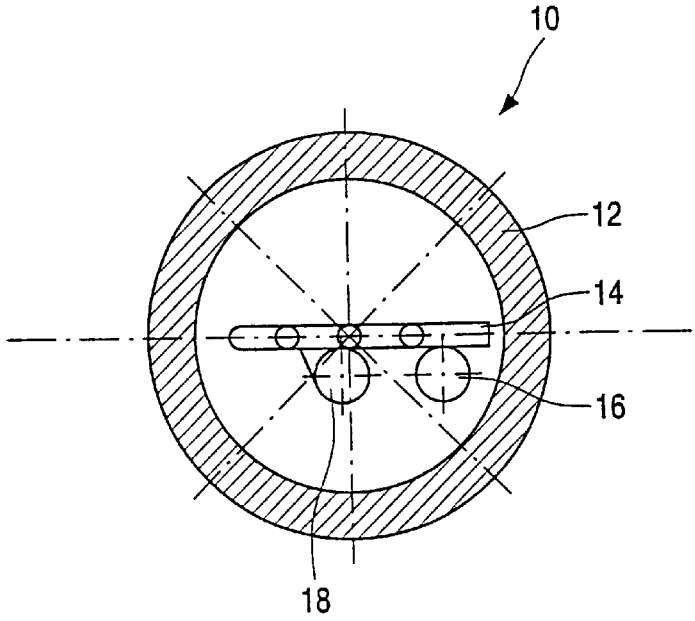
Figure 4:
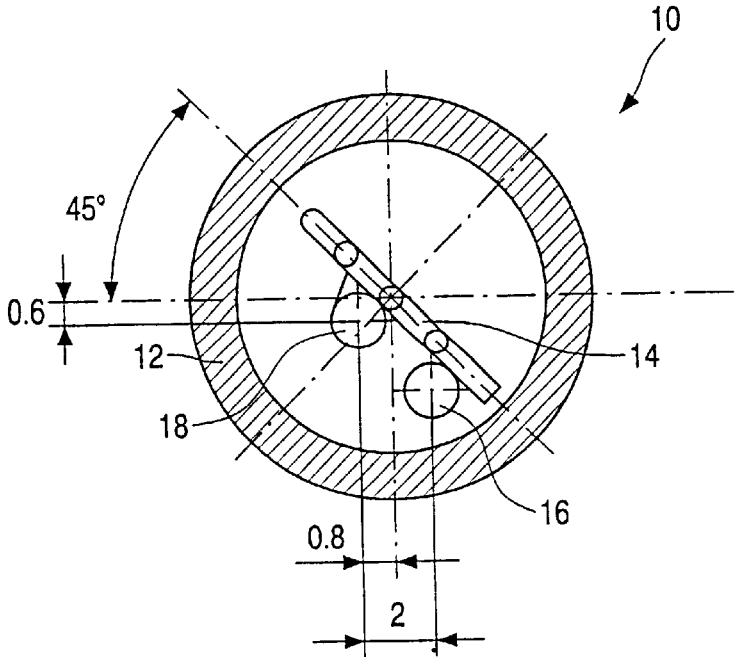

Further particulars and advantages of the invention will become apparent from the subsequent description of an embodiment in conjunction with the drawing, in which:

FIG. 1 shows a high-power dual-filament incandescent lamp according to the invention in a first side elevation, FIG. 2 shows the lamp of FIG. 1 in a second side elevation rotated through 90° about the central axis of the lamp bulb, FIG. 3 shows the lamp in a cross-section taken on the line III—III in FIG. 1, viewed from the lamp cap to the top of the lamp, and FIG. 4 shows the lamp in the same way as FIG. 3 in its correct operational position in a reflector.

FIGS. 1 to 4 show a high-power dual-filament incandescent lamp 10 in its entirety, which lamp is designed for use in a reflector which is not shown in any detail, said incandescent lamp comprising two incandescent coils 16 and 18 which are arranged substantially parallel to one another in a lamp bulb or burner 12 and which can be operated alternately by means of respective current supply means 14. One incandescent coil 16 is denoted the main coil and the other coil 18 the auxiliary coil. A lamp base 20 which is known per se is provided at one end of the bulb 12, while an absorption zone 22 impermeable to light is arranged at the opposite end.

As is apparent from FIGS. 1 and 2, the two incandescent coils are arranged displaced relative to one another in the direction of the main axis of the incandescent coils, and thus in the direction of the main axis of the bulb 12, i.e. by 2 mm in this embodiment, measured from the upper edges of the coils facing towards the reflector top zone 22.

As is evident from FIG. 3 and particularly from FIG. 4, the bulb in its correct operational position shows a displacement transversely to the main or central axis of the auxiliary coil 18, and thus to the optical axis of the reflector (not shown), while the optical axis in FIG. 4 issues perpendicularly to the auxiliary coil 18 from the plane of drawing, whereas the bulb axis issues from the drawing at the point of intersection of the dash-dot lines.

The main coil 16 here lies approximately 2 mm to the right next to a vertical plane in which the bulb axis of the reflector is situated, while the auxiliary coil 18 lies approximately 0.8 mm to the left next to this plane.

Both coils in their correct operational positions (FIG. 4), moreover, lie below a horizontal plane comprising the bulb axis, the main coil 16 lying approximately 2.6 mm and the auxiliary coil 18 lying 0.6 mm below this plane.

As is immediately obvious, the sealing plane is also arranged at an angle to the horizontal and vertical planes. This is visible particularly in FIG. 4. In the present example, this angle is 45° and was chosen such that both coils 16 and 18 are contiguous to or slightly intersect the plane in which the support wires 14 are arranged. In this manner the necessary displacement can be provided by the coil wires alone, while the support wires 14 can be given a construction which is as short and stable as possible. The total construction is extremely stable and precise in this manner.

Numerous modifications and further embodiments are possible within the scope of the invention, for example relating to the dimensions of the displacements of the incandescent coils in vertical and horizontal direction transversely to the optical axis, and also the displacement of the coils to one another in the direction of the optical axis. Essential for the invention is, in all cases, that both coils are displaced with respect to the central axis of the bulb such that a bulb of reduced diameter compared with the known bulbs can be used, while the minimum distance of the coils to one another and to the bulb inside is observed.

What is claimed is:

1. A lamp comprising a bulb which has a bulb axis and encloses a main coil and an auxiliary coil whose coil axes are directed parallel to the bulb axis, and comprising a base means (20) for mounting said lamp in a lampholder in a defined position, characterized in that the bulb axis is vertically as well as horizontally displaced with respect to the coil axis of the auxiliary coil (18) and the coil axis of the main coil (16), said auxiliary coil (18) being arranged such that it is positioned a distance laterally of a vertical plane in which the bulb axis is situated, and said main coil (16) being arranged such that it is positioned a distance laterally of said vertical plane at a side of said vertical plane opposite said auxiliary coil, and wherein both main coil and auxiliary coil are situated below a horizontal plane comprising the bulb axis.

2. A lamp as claimed in claim 1, characterized in that (the main coil 16) is arranged such that in its correct operating position it is positioned between 0.7 and 1.7 mm laterally of a said vertical plane in which the bulb axis is situated.

3. A lamp as claimed in claim 1, characterized in that the main coil (16) is arranged such that in its correct operating position it is positioned between 2.1 and 3.1 mm below a horizontal plane in which the bulb axis is situated.

4. A lamp as claimed in claim 1, characterized in that the auxiliary coil (18) is arranged such that in its correct operational position it is positioned at a distance of between 0.3 and 1.3 mm laterally of the vertical plane in which the bulb axis is situated at the side of said plane opposed to the main coil.

5. A lamp as claimed in claim 1, characterized in that the auxiliary coil (18) is arranged such that in its correct operational position it is positioned at a distance of between 0.1 and 1.1 mm below the horizontal plane in which the bulb axis is situated.

* * * * *